US006651271B2

(12) United States Patent
Bentley

(10) Patent No.: US 6,651,271 B2
(45) **Date of Patent: *Nov. 25, 2003**

(54) TUB WITH FOOT-ACTUATED HANDLE

(76) Inventor: Samuel Bayne Bentley, 80 S. Market St., 2nd Floor, San Jose, CA (US) 95113

( * ) Notice: Subject to any disclaimer, the term of this patent is extended or adjusted under 35 U.S.C. 154(b) by 0 days.

This patent is subject to a terminal disclaimer.

(21) Appl. No.: 10/082,439

(22) Filed: Feb. 22, 2002

(65) Prior Publication Data

US 2003/0159209 A1 Aug. 28, 2003

(51) Int. Cl.[7] ..... E03C 1/04

(52) U.S. Cl. ..... 4/675; 4/676; 4/677; 4/661; 4/604

(58) Field of Search ..... 4/675–677, 661, 4/604, 605, 559; 16/430, 901; D23/245, 250, 277

(56) References Cited

U.S. PATENT DOCUMENTS

| | | | | | |
|---|---|---|---|---|---|
| 1,432,916 | A | * | 10/1922 | Schwartz | D23/277 |
| 2,010,791 | A | * | 8/1935 | Sakier | D23/277 |
| D143,100 | S | * | 12/1945 | Stanitz | D23/250 |
| D157,312 | S | * | 2/1950 | Young | D23/250 |
| D159,311 | S | * | 7/1950 | Arcularius | D23/250 |
| D187,096 | S | * | 1/1960 | Young | D23/250 |
| D191,191 | S | * | 8/1961 | Kawolics | D23/250 |
| 3,465,379 | A | * | 9/1969 | Forte | 4/661 |
| 4,514,868 | A | | 5/1985 | Visinand | 4/541 |
| 4,706,311 | A | | 11/1987 | Jarosinski | 4/546 |
| 4,729,135 | A | | 3/1988 | Titterington | 4/597 |
| D434,475 | S | | 11/2000 | Meda | D23/252 |
| D434,476 | S | | 11/2000 | Meda | D23/252 |
| 6,145,140 | A | | 11/2000 | Fernie et al. | 4/577.1 |
| 6,220,266 | B1 | | 4/2001 | Hennessy | 137/1 |
| D450,808 | S | | 11/2001 | Gottwald | D23/250 |

* cited by examiner

*Primary Examiner*—John Rivell
*Assistant Examiner*—Azadeh Kokabi
(74) *Attorney, Agent, or Firm*—Thomas Schneck; David M. Schneck; Nissa Strottman

(57) ABSTRACT

A handle for controlling water temperature and/or water flow is mounted on the side of a bathtub and shaped such that the handle may be controlled by a bather's foot. The vanes of the handle are shaped to accommodate the shape of the foot and are spaced apart from each other to allow easy operation of the handle.

23 Claims, 3 Drawing Sheets

TUB WITH FOOT-ACTUATED HANDLE

FIELD OF THE INVENTION

This invention relates to a bath fixture, particularly a bathtub with a mechanism for controlling the temperature of water entering the bath.

BACKGROUND OF THE INVENTION

Bathtubs and faucet handles are well-known in the prior art. The "traditional" bathtub features a faucet with handles at the opposite end of the tub from the bather's head. The faucet handles are almost always located immediately next to the faucet; all of these faucets are meant to be operated by hand.

This arrangement is not convenient for the bather soaking in the tub while water enters the tub or for the elderly or handicapped bather. The configuration discussed above requires the bather to shift around in the tub to operate the faucet handles. While this is an annoyance to many people, it is uncomfortable and even dangerous to the elderly, the handicapped, or those suffering from a chronic condition or injury such as arthritis or back pain. Another problem with this configuration is that those whose use of their hands is limited, due to arthritis, for instance, may be unable to manipulate the handles, which generally require the user to close their fingers over the handle, with their hands.

While the prior art does contain numerous patents which disclose devices to assist the handicapped or elderly person's safety and mobility while bathing, most of the prior art discusses a bathtub with handles for controlling water temperature and flow that have to be operated by hand in the usual way. A bathtub equipped with other options for water control would benefit the elderly and handicapped by giving them greater independence and control over their bathing environment. This bathtub would also benefit bathers who are neither elderly or handicapped.

It is an object of this invention to provide a bathtub with a mechanism for controlling water temperature and/or water flow that is not controlled by a user's hand.

SUMMARY OF THE INVENTION

The above object has been met with a handle for controlling water temperature and/or water flow that is mounted on a valve placed on a wall of a bathtub and is shaped such that the handle may be controlled by a bather's foot. In one embodiment, the handle has three convex vanes radiating from a central pivot axis. The handles are asymmetrically spaced apart from each other at angles that will allow a bather's foot to easily manipulate the handle. In one embodiment, the handle can control both water temperature and water flow. In another embodiment, two handles, one to control water temperature and one to control water flow, may be installed in the tub. In yet another embodiment, the handle may be mounted in the bathtub with a shower fixture such that the handle may be manipulated by the foot of someone taking a bath and by the hand of someone taking a shower.

DETAILED DESCRIPTION OF THE INVENTION

Figure 1A:
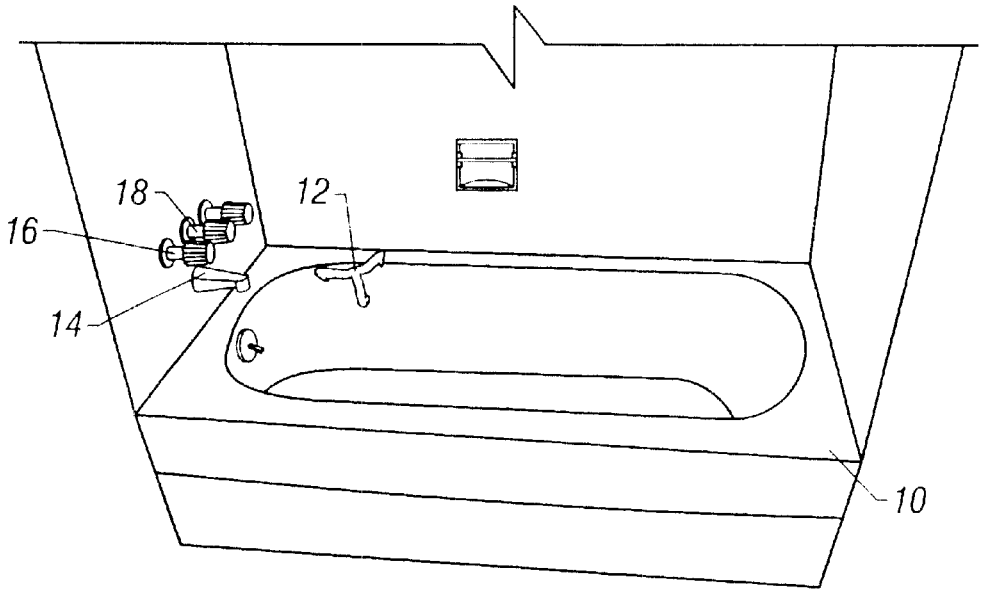
FIG. 1*a* is view of a bathtub with a foot-actuated handle in accordance with the invention.

FIG. 1*a* shows a bathtub 10 with a foot-actuated handle 12. The bathtub 10 may be of any shape and may be free-standing or constructed such that the bathtub and the adjacent wall(s) are a single unit. In addition to the foot-actuated handle 12, the bathtub 10 is also equipped with a faucet 14 and hand-operated handles for controlling water temperature 16 and shower 18. In other embodiments, the foot-actuated handle.12 may be mounted anywhere the bathtub 10, depending on the tub's 10 shape and orientation; neither the hand-operated handles 16 or shower 18 need be present. The handle 12 may control temperature, water flow, or both temperature and water flow.

Figure 1B:
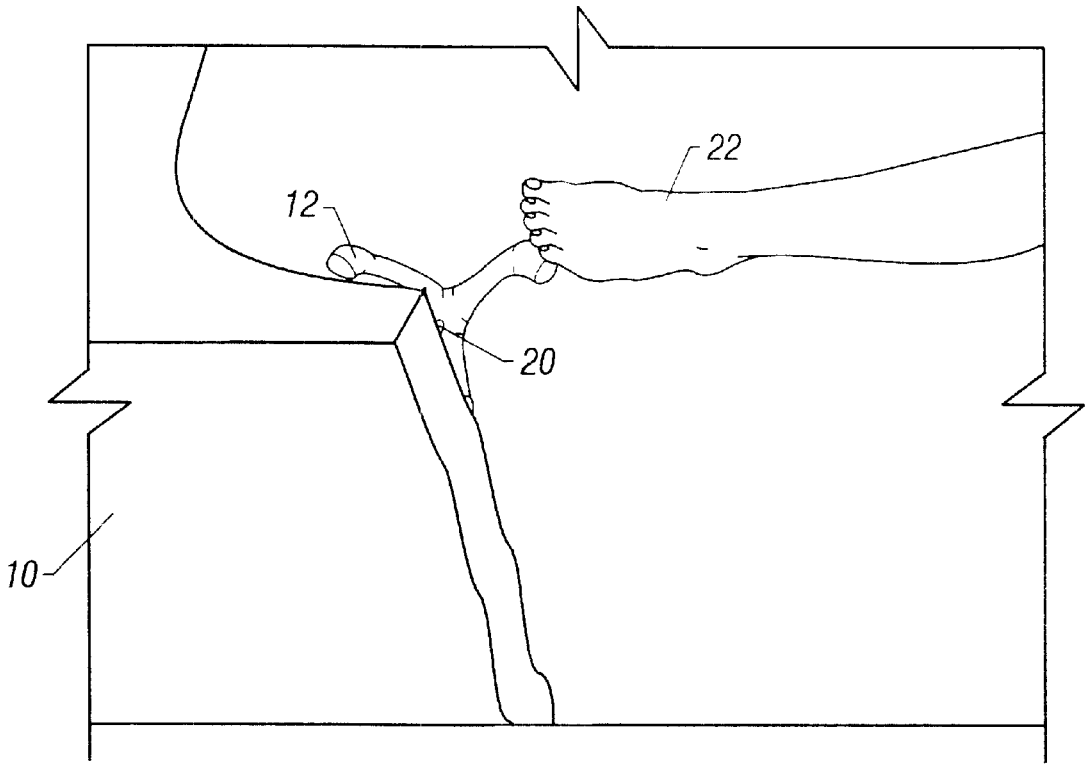
FIG. 1*b* is a cutaway view of the bathtub with a foot-actuated handle being operated by a bather's foot.

FIG. 1*b* shows how the foot-actuated handle 12 is operated by a bather's foot 22. In this embodiment, the handle 12 is mounted on a standard valve 20 on a sidewall of the bathtub 10. (The handle 12 is shown here on a different sidewall of the bathtub 10 than was shown in FIG. 1*a* for purposes of clarity of illustration. As noted above, the handle 12 may be mounted anywhere in the bathtub 10. Depending on where the handle 12 is mounted the valve 20 may require non-standard threading in order to rotate in the appropriate direction. However, this should be clear to someone skilled in the art.) The bather's outstretched foot 22 can manipulate the handle 12 to adjust the temperature and/or flow of water entering the bath. As shown here (and discussed in greater detail below in FIG. 3), the vanes of the handle 12 are structured such that the handle 12 may be easily operated to adjust the temperature and/or flow of water into the bathtub. While this figure shows the handle 12 being operated by the ball of the bather's foot 22, the handle may also be operated by the toes or heel of the foot 22.

Figure 3:
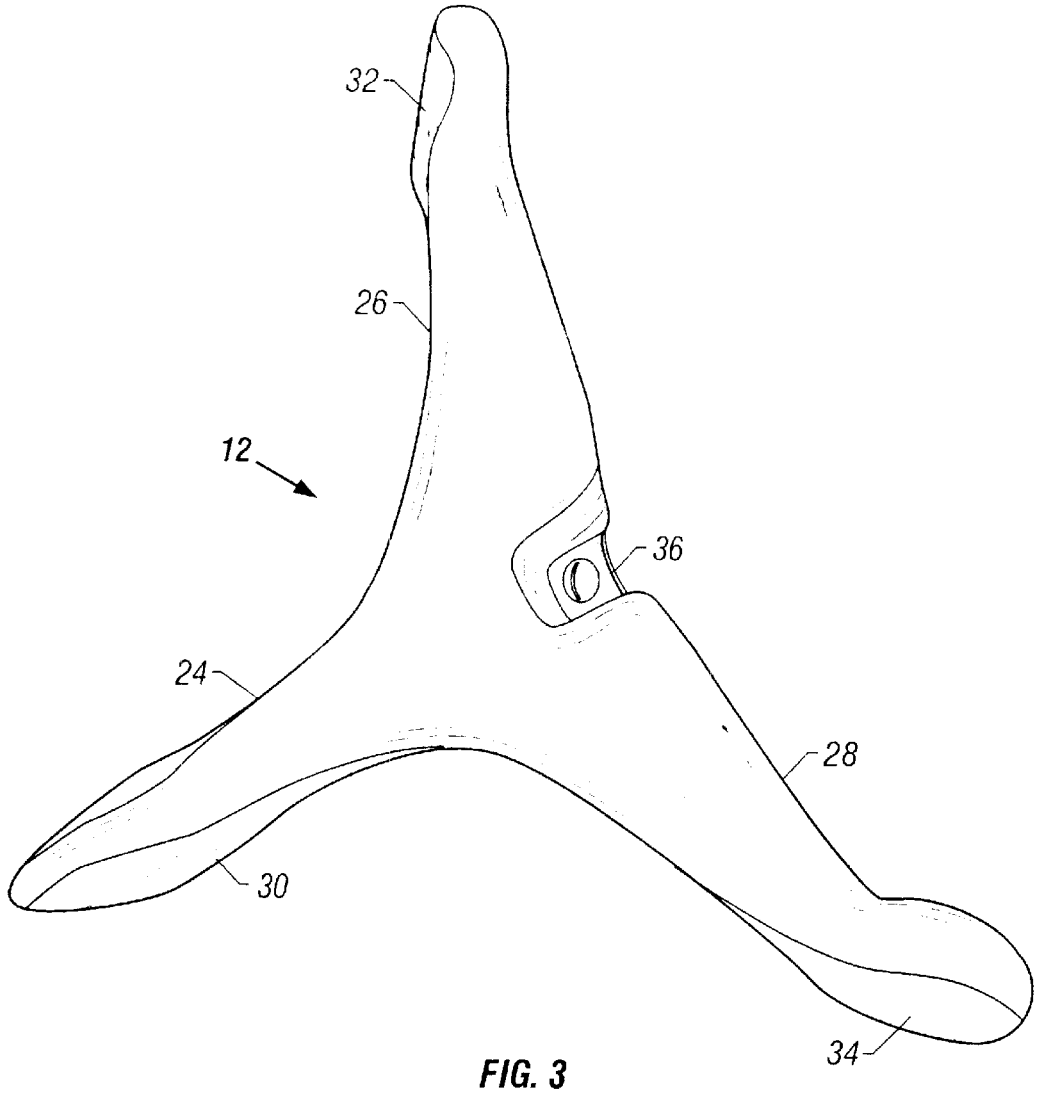
FIG. 3 is another overhead view of the handle shown in FIG. 1*a*.

With respect to FIG. 3, the handle 12 has three vanes 24, 26, 28. The handle 12 is mounted on a pivot axis 36 attached to a standard valve (see FIG. 1*b*). At the end of each of the vanes 24, 26, 28 is a tab 30, 32, 34. The tabs 30, 32, 34 allow the bather's foot to gain more purchase on the handle 12 and thus turn the handle 12. The vanes 24, 26, 28 are asymmetrically spaced around the handle's 12 pivot axis 36—in this case the "central" vane 24 is 105 degrees apart from the other two vanes 26, 28, which are 150 degrees apart from each other. The vanes 24, 26, 28 of the handle 12 may be separated by different angles in other embodiments. For instance, in other embodiments, two of the vanes 26, 28 are each between 95 and 115 degrees apart from the third vane 24, while the two vanes 26, 28 are separated from each other by an angle between 130 and 170 degrees.

Figure 2:
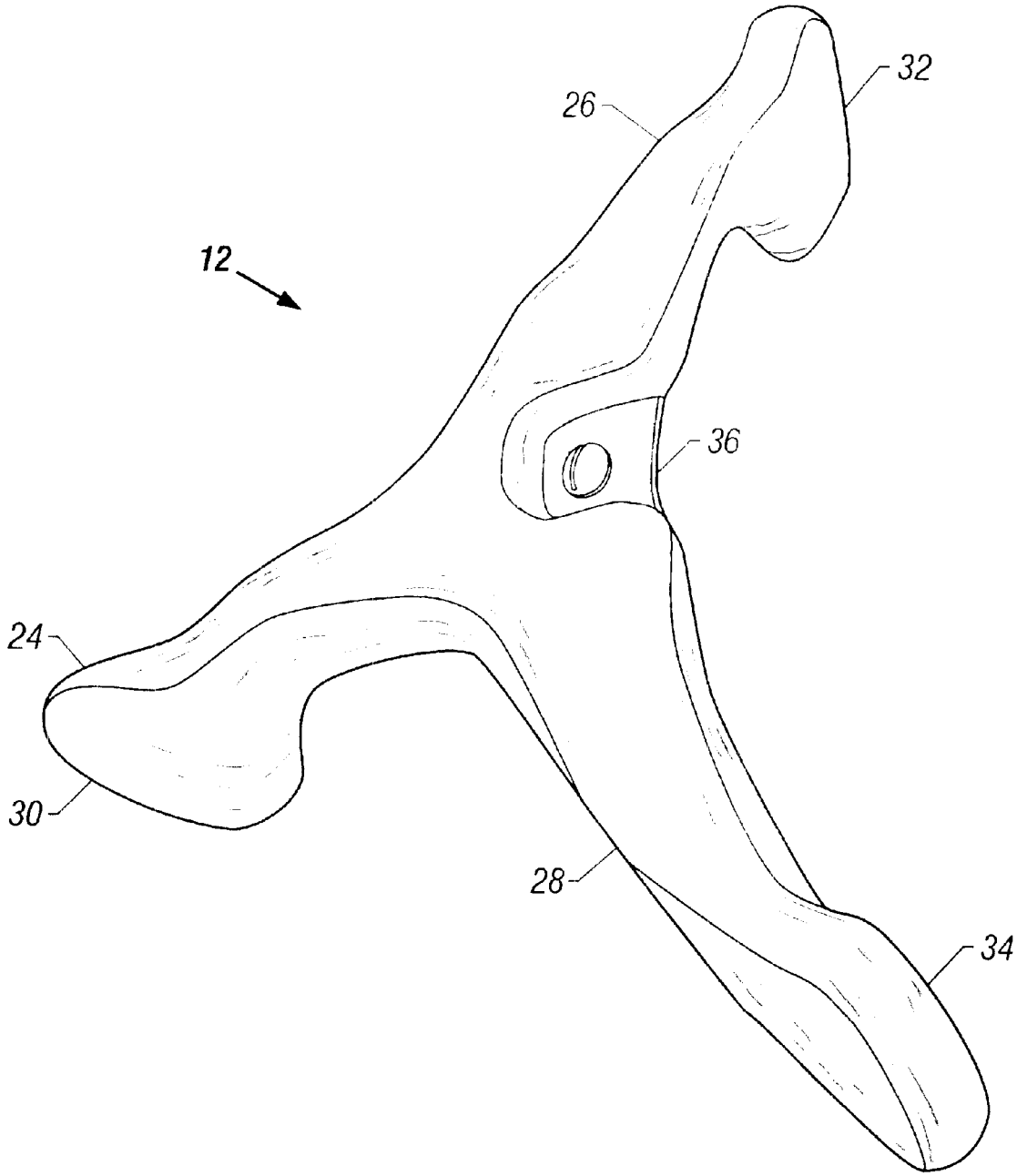
FIG. 2 is an overhead view of the handle shown in FIG. 1*a*.
Figure 4:
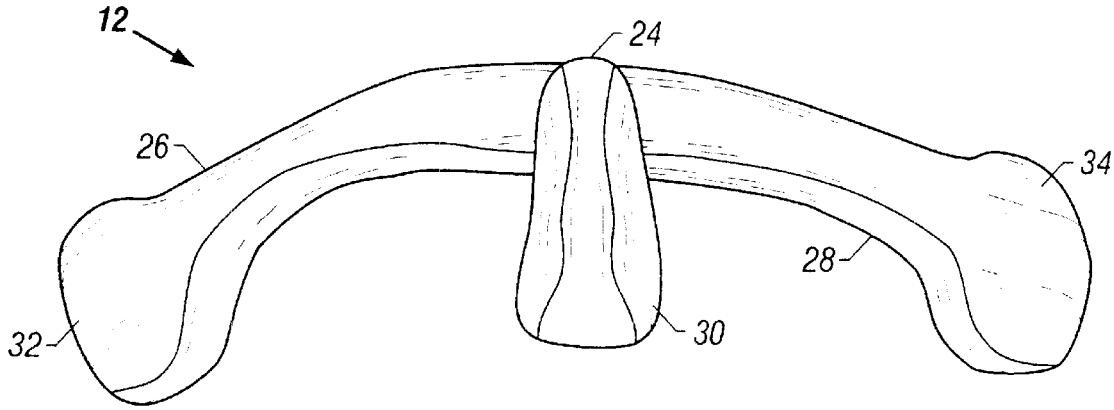
FIG. 4 is a side view of the handle shown in FIG. 1*a*.

With reference to FIGS. 2, 3, and 4, in this embodiment the tab 30 at the end of the central vane 24 has more of a wedge shape than the other two tabs 32, 34, which are flatter. The wedge shape allows the central vane 24 to present the same angle to the bather whether the handle 12 is in an active position (water entering the tub) or an inactive position (no water entering the tub). In other embodiments, all three tabs may have the same shape.

As shown in FIG. 4, the handle's 12 vanes 24, 26, 28 are arcuately shaped, giving the handle 12 a dome-like appearance. The vanes 24, 26, 28 are shaped to accommodate the shape of the foot; this allows the bather greater control and comfort when manipulating the handle 12.

Each vane 24, 26, 28 is at least 4 inches long and at least ½ inch wide. The tabs 30, 32, 34 are each at least 2 inches wide.

In another embodiment, the handle can be placed in a bathtub/shower unit such that it may be operated by the foot of a bather or the hand of someone taking a shower. The handle's vanes are large enough to ensure that even someone who lacks fine motor control in his or her hands can operate the handle, for example with a fist, an outstretched hand, or even the lower arm.

In yet another embodiment, the bathtub may contain two handles that may be operated by foot. One of these handles may control water flow while the other controls the temperature (i.e., mixing of hot and cold water supplies) of the water entering the tub. Alternatively, one handle may control the flow of hot water while the other controls the flow of cold water.

What is claimed is:

1. A bath fixture comprising:

a) a bathtub of a size accommodating a seated adult bather having outstretched legs and feet; and b) a handle for controlling temperature of water entering the bathtub from a water supply spout, said handle mounted on a valve on a side surface of the bathtub at a distance accessible to a foot of the bather, said handle having a plurality of vanes spaced about a pivot axis, each of the plurality of vanes having a tab at a terminal end of the vane opposite from the pivot axis, whereby said foot of said bather can engage one of the tabs and turn the handle so as to effect a change in the temperature of the water entering the bathtub.

2. The bath fixture of claim 1 wherein the handle also controls flow of water into the bathtub.

3. The bath fixture of claim 1 wherein the handle has three vanes.

4. The bath fixture of claim 3 wherein two of the vanes of the handle are each between 95 and 115 degrees apart from the third vane of the handle.

5. The bath fixture of claim 3 wherein two of the vanes of the handle are each 105 degrees apart from the third vane of the handle.

6. The bath fixture of claim 3 wherein two of the vanes of the handle are between 130 and 170 degrees apart.

7. The bath fixture of claim 1 wherein the vanes of the handle are convex.

8. The bath fixture of claim 1 wherein the vanes of the handle are each at least 4 inches long.

9. The bath fixture of claim 1 wherein the vanes of the handle are each at least ½ inch wide.

10. The bath fixture of claim 1 wherein the tab at the end of the vane is at least 2 inches wide.

11. The bath fixture of claim 1 further including another handle mounted on a side surface of the bathtub.

12. The bath fixture of claim 1 further including a shower head, wherein a person taking a shower may operate the handle by hand.

13. A bath fixture comprising:

a) a bathtub of a size accommodating a seated adult bather having outstretched legs and feet; and b) a handle for controlling temperature of water entering the bathtub from a water supply spout, said handle mounted on a valve on a side surface of the bathtub at a distance accessible to a foot of the bather, said handle having three vanes spaced on a pivot axis, the three vanes each having a tab at a terminal end of the vane opposite from the pivot axis, whereby said foot of said bather can engage one of the tabs and turn the handle so as to effect a change in the temperature of the water entering the bathtub.

14. The bath fixture of claim 13 wherein the handle also controls flow of water into the bathtub.

15. The bath fixture of claim 13 wherein the vanes of the handle are convex.

16. The bath fixture of claim 13 wherein two of the vanes of the handle are each between 95 and 115 degrees apart from the third handle.

17. The bath fixture of claim 13 wherein two of the vanes of the handle are between 130 and 170 degrees apart.

18. The bath fixture of claim 13 wherein the vanes of the handle are each at least 4 inches long.

19. The bath fixture of claim 13 wherein the vanes of the handle are each at least ½ inch wide.

20. The bath fixture of claim 13 wherein the tab at the end of the vane is at least 2 inches wide.

21. The bath fixture of claim 13 further including another handle mounted on a side surface of the bathtub.

22. The bath fixture of claim 13 further including a shower head, wherein a person taking a shower may operate the handle by hand.

23. The bath fixture of claim 13 wherein two of the vanes of the handle are each 105 degrees apart.

* * * * *